US007735282B2

(12) United States Patent
Price

(10) Patent No.: US 7,735,282 B2
(45) Date of Patent: Jun. 15, 2010

(54) FULLY INSULATED FRAME BUILDING PANEL SYSTEM

(76) Inventor: Philip Anthony Price, Lower Wild Boar House, Rawcliffe Road, St. Michaels (GB) PR3O5Z ( * ) Notice: Subject to any disclaimer, the term of this patent is extended or adjusted under 35 U.S.C. 154(b) by 817 days.

(21) Appl. No.: 10/918,848

(22) Filed: Aug. 16, 2004

(65) Prior Publication Data

US 2005/0284064 A1 Dec. 29, 2005

(30) Foreign Application Priority Data

Jun. 9, 2004 (GB) ..... 0412796.5

(51) Int. Cl.
*E04B 5/00* (2006.01)

(52) U.S. Cl. ..... 52/408; 52/407.5

(58) Field of Classification Search ..... 52/79.1, 52/79.6, 86, 302.1, 309.4, 309.7, 309.8, 309.9, 52/309.11, 407.1, 407.3, 407.4, 407.5, 404.2, 52/404.3, 404.4, 408, 411, 412, 506.1, 506.04, 52/783.1, 783.13; 119/218; 215/385, 223; 220/223

See application file for complete search history.

(56) References Cited

U.S. PATENT DOCUMENTS

| | | | | |
|---|---|---|---|---|
| 2,716,993 | A * | 9/1955 | Codrick | 135/136 |
| 3,313,072 | A * | 4/1967 | Cue | 52/302.3 |
| 3,401,825 | A * | 9/1968 | Weiss | 220/787 |
| 4,098,044 | A * | 7/1978 | Slavik | 52/302.1 |
| 4,192,333 | A * | 3/1980 | Sato | 135/124 |
| 4,589,546 | A * | 5/1986 | Sunderland | 206/315.11 |
| 4,937,125 | A | 6/1990 | Sanmartin et al. | |
| 5,059,463 | A * | 10/1991 | Peters | 428/64.1 |
| 5,156,111 | A * | 10/1992 | Heggelund | 119/218 |
| 5,511,684 | A * | 4/1996 | Weaver, Jr. | 220/630 |
| 5,743,056 | A * | 4/1998 | Balla-Goddard et al. | 52/309.11 |

(Continued)

FOREIGN PATENT DOCUMENTS

| | | |
|---|---|---|
| DE | 119653633 | 6/1999 |

(Continued)

OTHER PUBLICATIONS

European Search Report dated Nov. 15, 2006 for European Application No. EP04254944.

(Continued)

*Primary Examiner*—Richard E Chilcot, Jr.
*Assistant Examiner*—Jessica Laux
(74) *Attorney, Agent, or Firm*—Michael Best & Friedrich LLP

(57) ABSTRACT

A fully insulated timber frame building panel system incorporating wall, ceiling and floor panels of varying dimensions which are made up of vertical timbers 20 and horizontal timbers 34 & 36 sheathed both sides 21 & 22 to create a cavity which is filled with expanding polyurethane insulation 27. Breather membrane 24 is then attached to the external face of the panel and heat reflecting membrane 25 to the internal face. Battens 23 & 38 are applied to the internal face of the panel, which is then sheathed in gypsum based boards 32 to form an air gap 29. Extruded polyurethane insulation 26 is fixed to the panel through the breather membrane 24. External cladding 31 is always fixed to the timber frame to create a cavity 30. This external cladding can be of a variety of materials.

12 Claims, 9 Drawing Sheets

U.S. PATENT DOCUMENTS

| | | | | |
|---|---|---|---|---|
| 5,921,043 | A * | 7/1999 | McDonald | 52/309.9 |
| 5,953,883 | A * | 9/1999 | Ojala | 52/794.1 |
| 6,170,696 | B1 * | 1/2001 | Tucker et al. | 220/793 |
| 6,233,890 | B1 * | 5/2001 | Tonyan | 52/302.3 |
| 6,279,824 | B1 * | 8/2001 | Park | 235/379 |
| 6,349,732 | B1 * | 2/2002 | Cooper | 135/133 |
| 6,557,313 | B1 | 5/2003 | Alderman | |
| 6,745,531 | B1 * | 6/2004 | Egan | 52/302.1 |
| 6,964,136 | B2 * | 11/2005 | Collins et al. | 52/209 |
| 7,032,356 | B2 * | 4/2006 | Layfield | 52/407.1 |
| 7,117,649 | B2 * | 10/2006 | Morris et al. | 52/302.3 |
| 2002/0108333 | A1 * | 8/2002 | Clayton | 52/302.1 |
| 2004/0000112 | A1 * | 1/2004 | Alderman | 52/407.3 |
| 2004/0003558 | A1 * | 1/2004 | Collins et al. | 52/302.1 |
| 2004/0068948 | A1 * | 4/2004 | Wrass | 52/309.7 |

FOREIGN PATENT DOCUMENTS

| | | |
|---|---|---|
| DE | 20014795 | 11/2000 |
| EP | 1331316 | 7/2003 |
| GB | 2275944 | 9/1994 |
| GB | 2279088 | 12/1994 |
| JP | 9072013 | 3/1997 |
| JP | 2001003477 | 1/2001 |
| JP | 2001342703 | 12/2001 |
| JP | 2003064769 | 3/2003 |
| WO | 8704744 | 8/1987 |
| WO | 0107725 | 2/2001 |

OTHER PUBLICATIONS

Great Britain Search Report dated Jan. 9, 2006 for Great Britain Application No. GB0511652.0.

Great Britain Search Report dated Oct. 25, 2005 for Great Britain Application No. GB0511652.0.

* cited by examiner

FULLY INSULATED FRAME BUILDING PANEL SYSTEM

This invention relates to an external timber frame system wall, ceiling or floor panel of varying dimensions and its method of construction, which includes CLS (Canadian Lumber Standard) timber, either Oriented Strand Board (OSB) or Plywood, breather membrane, expanded polyurethane foam insulation, extruded polyurethane foam insulation, heat reflecting membrane (HRM) and a gypsum based board.

This panel is used in the construction of commercial, public service and residential buildings.

The object of this invention is to supply a manufactured external wall, ceiling or floor panel system, which includes a panel fully insulated in manufacture.

Accordingly this timber frame panel after manufacture and used in the construction of a building with other materials forms part of the thermal barrier, which removes the necessity to have a central heating system in cold climates and reduces the use of air conditioning in warm climates.

The system contains wall, ceiling and floor panels comprising of wood, plastic and metal and adds gypsum based products and a method of construction.

Figure 1:
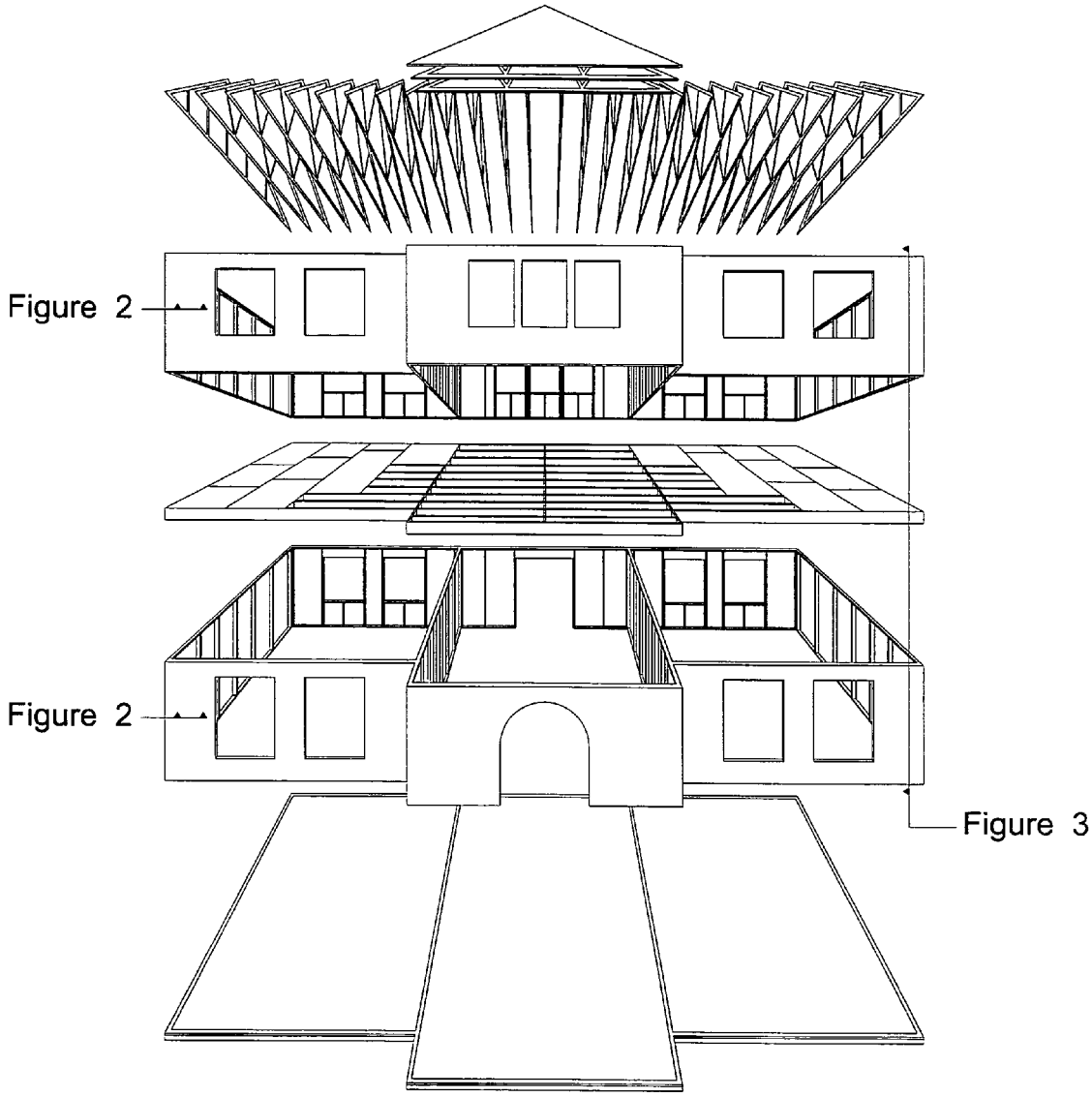

A preferred embodiment of the inventions will now be described in reference to accompanying drawings in which:

FIG. 1—shows an exploded diagram of a typical Timber Frame two storey detached building.

Figure 2:
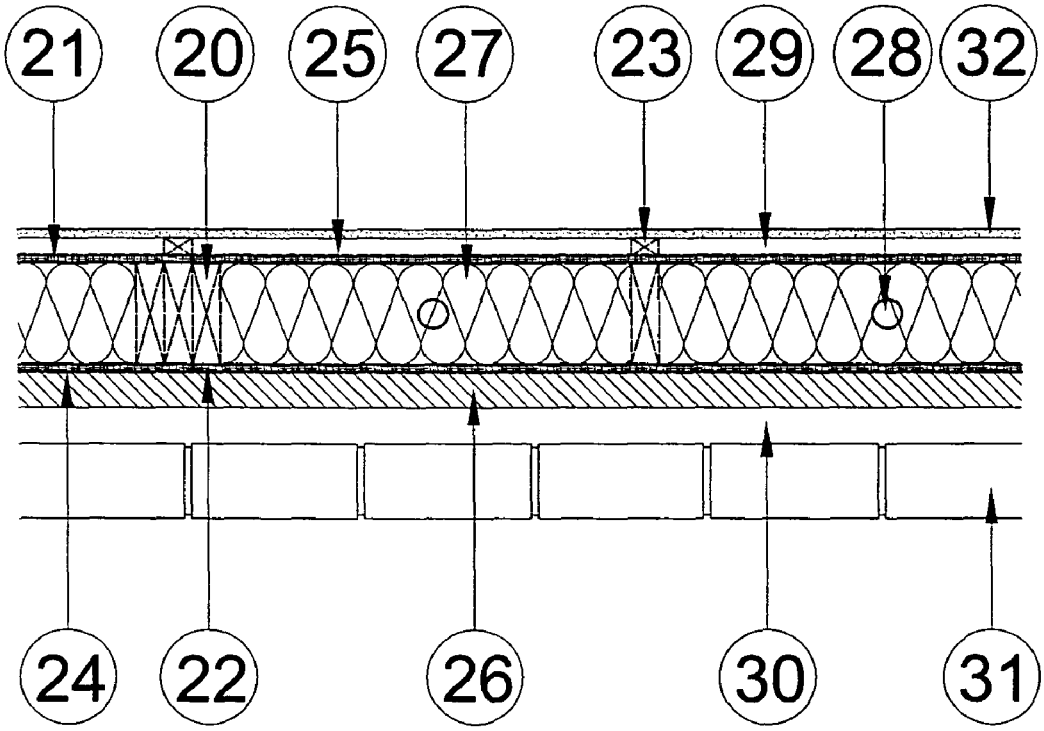

FIG. 2—shows a plan section through the system.

Figure 3:
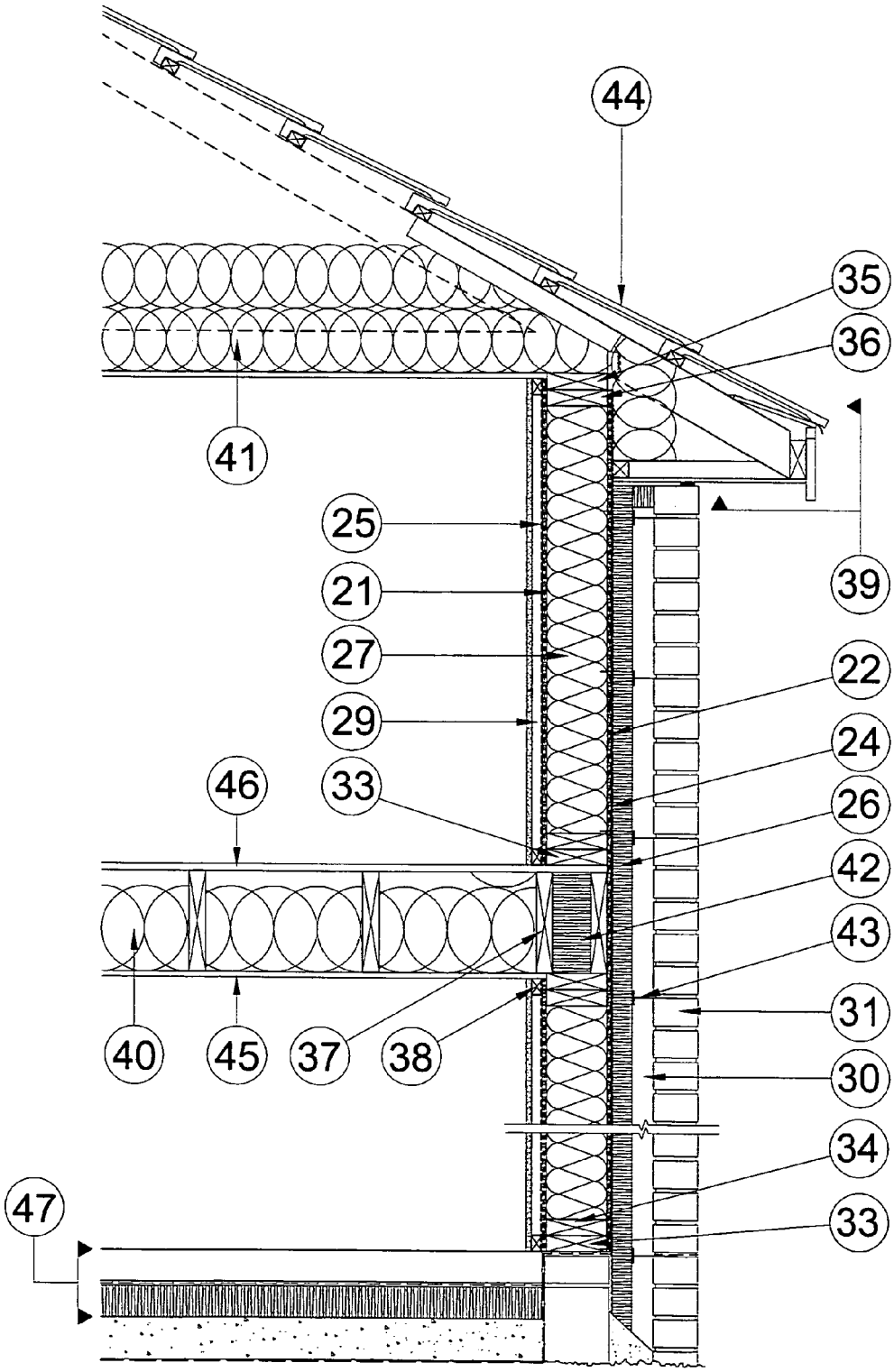

FIG. 3—shows a vertical section through a two storey building house.

Figure 4:
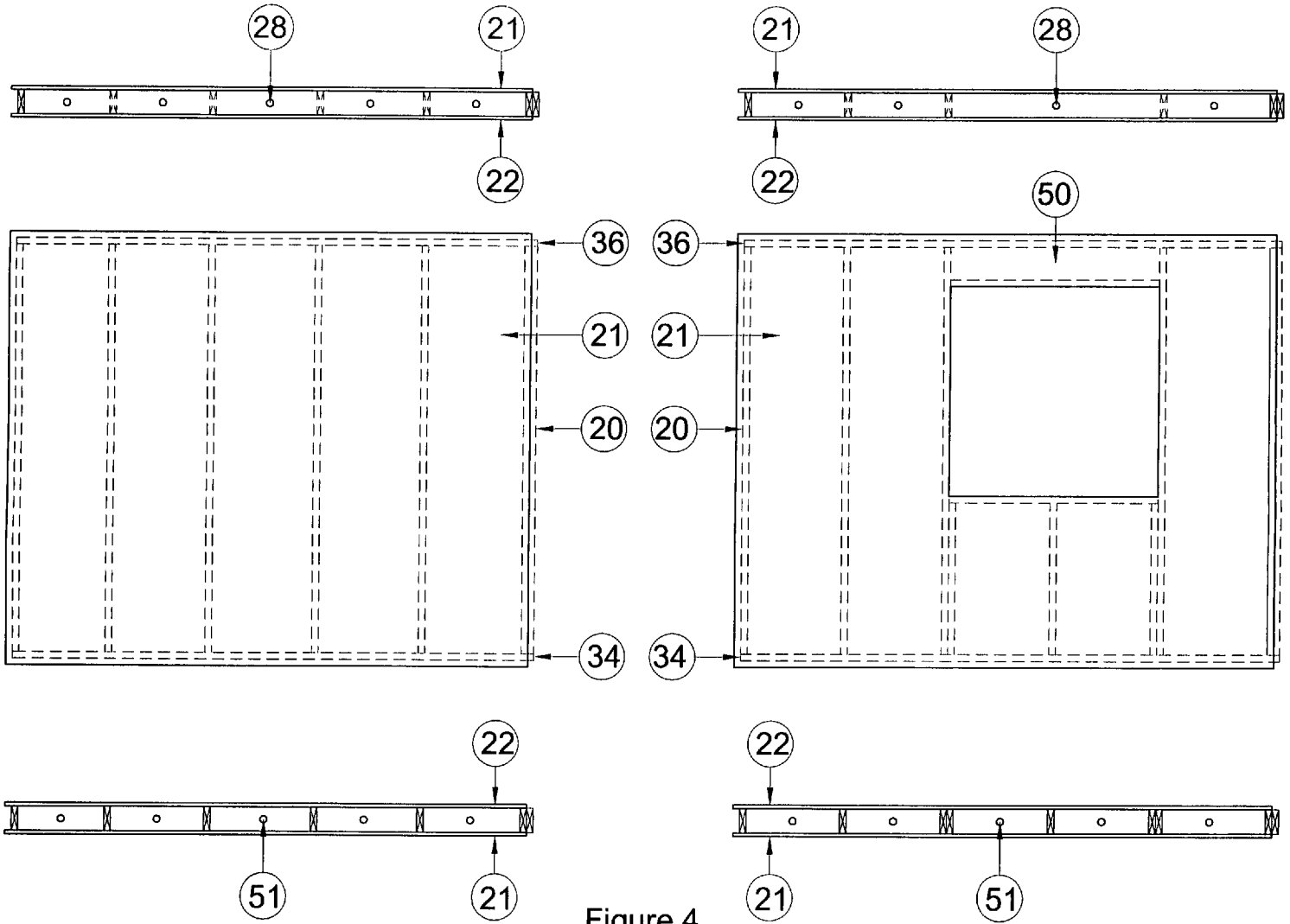

FIG. 4—shows elevations of external system wall panels with and without a window aperture. It also shows a top and bottom end elevation for each of the two system wall panels.

Figure 5:
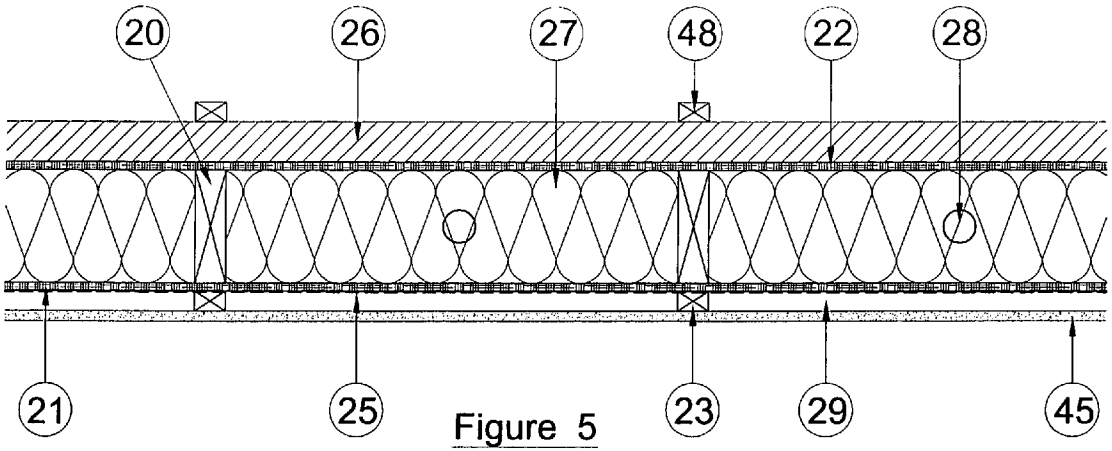

FIG. 5—shows an elevation of a system roof panel

Figure 6:
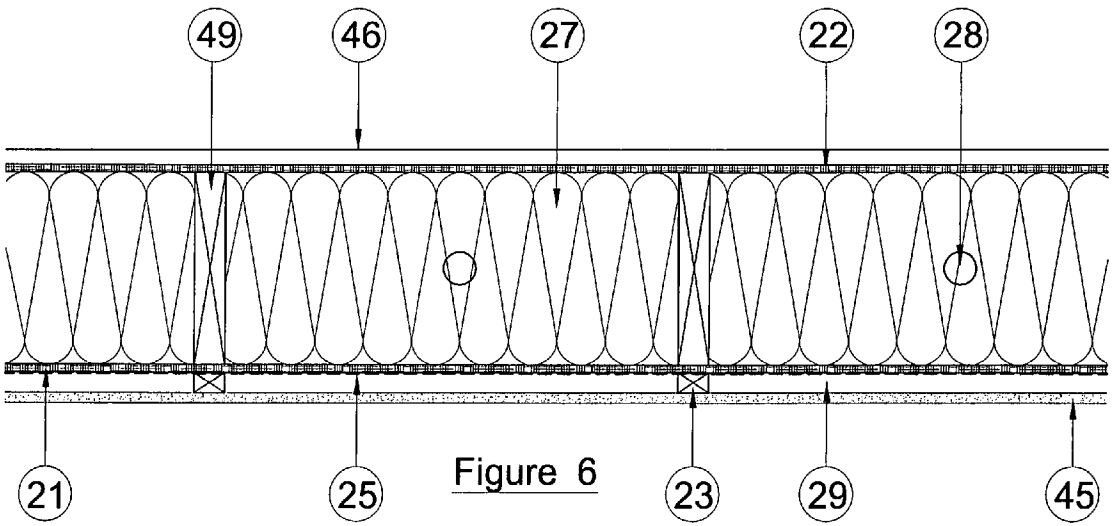

FIG. 6—shows a system floor panel

Figure 7:
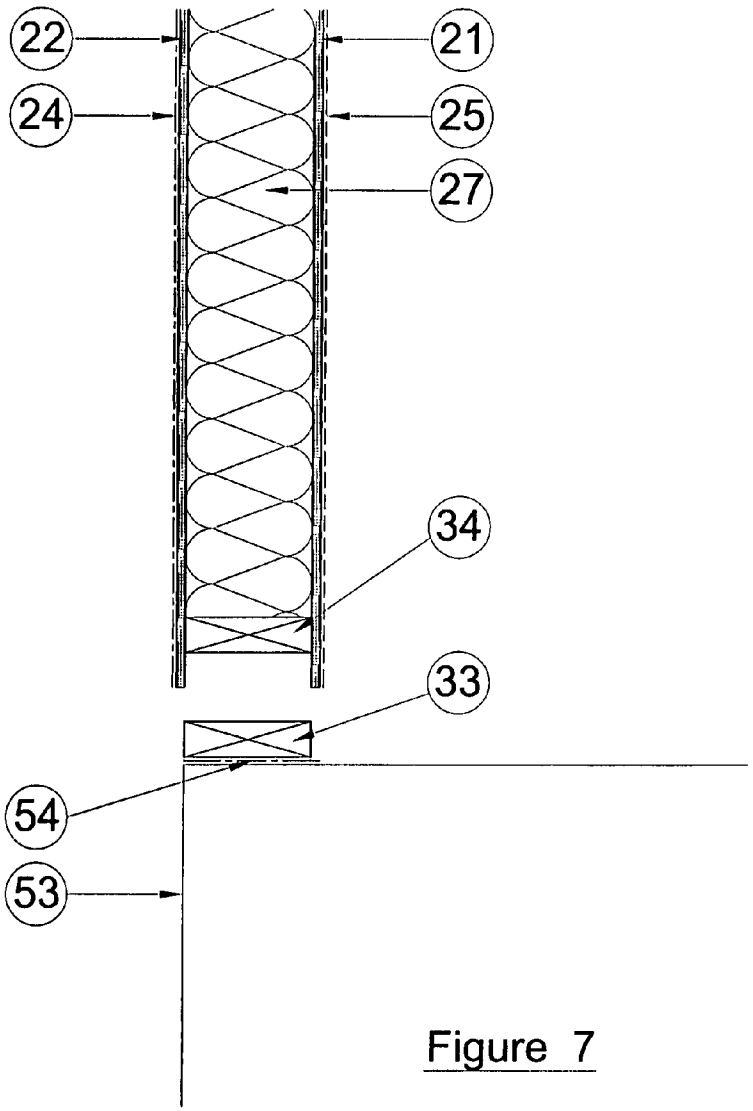

FIG. 7—shows a vertical section through a system wall panel junction prior to fixing.

Figure 8:
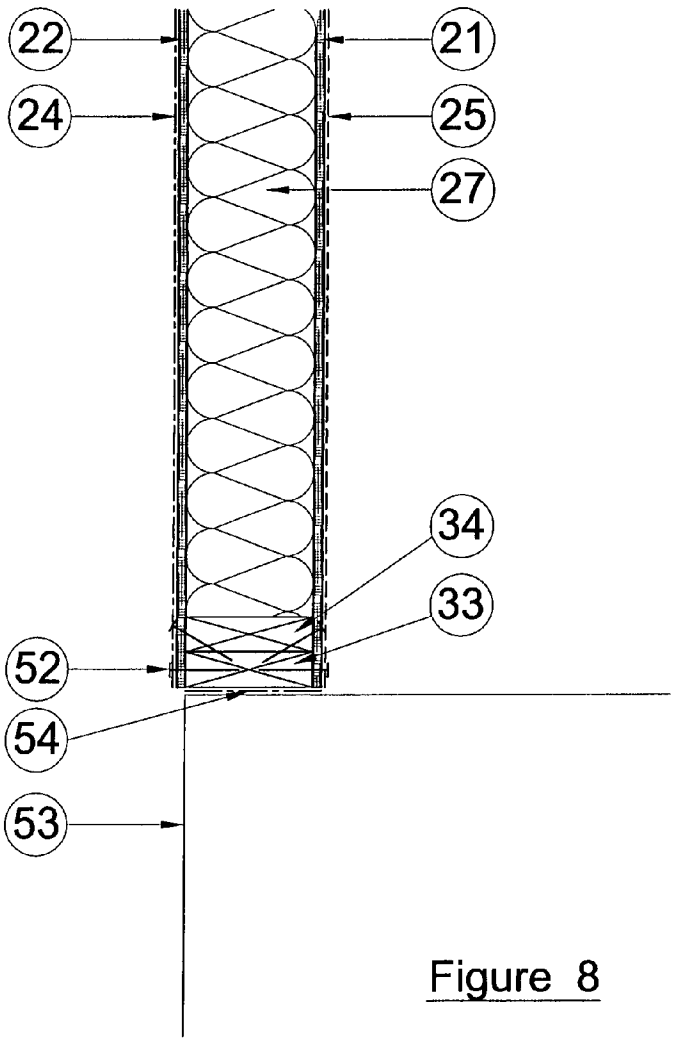

FIG. 8—shows a typical vertical section through the external system wall panel showing the fixing at the base.

Figure 9:
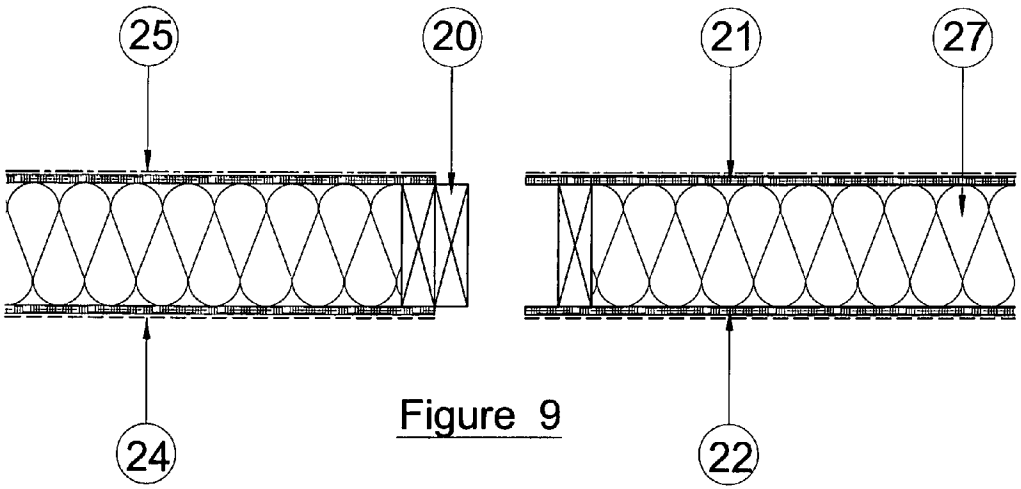

FIG. 9—shows a plan section of a through a system wall panel junction prior to fixing.

Figure 10:
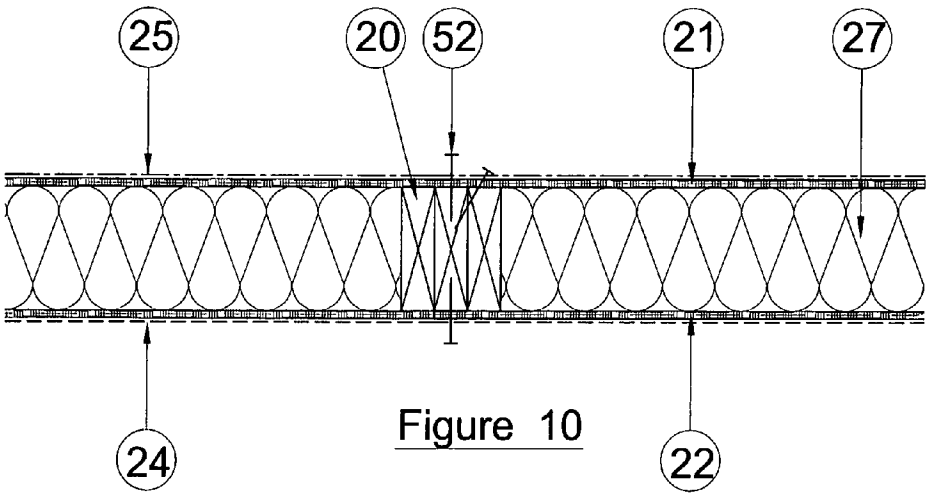

FIG. 10—shows a plan section of a through a system wall panel junction after fixing.

Figure 11:
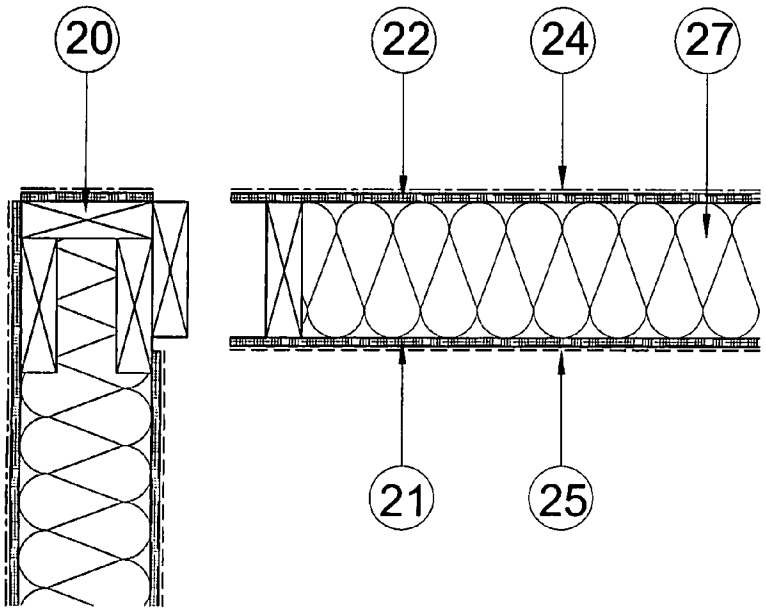

FIG. 11—shows a plan section of a system wall panel external corner junction prior to fixing.

Figure 12:
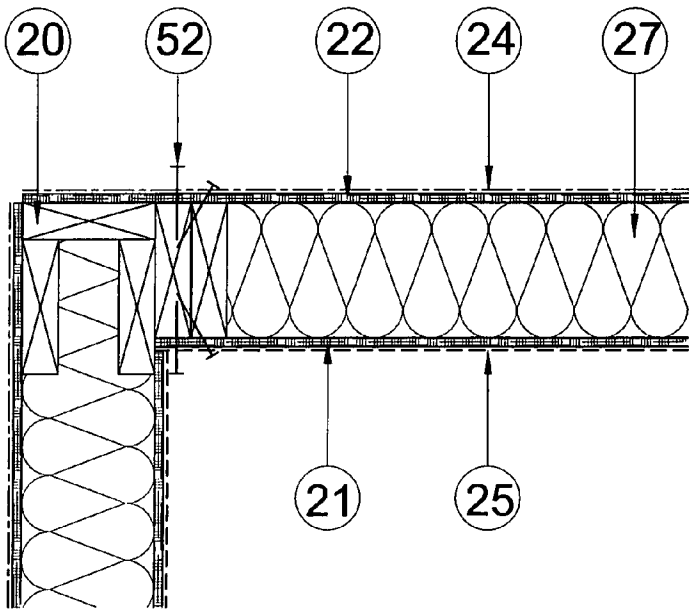

FIG. 12—shows a plan section of a system wall panel external corner junction after fixing.

Figure 13:
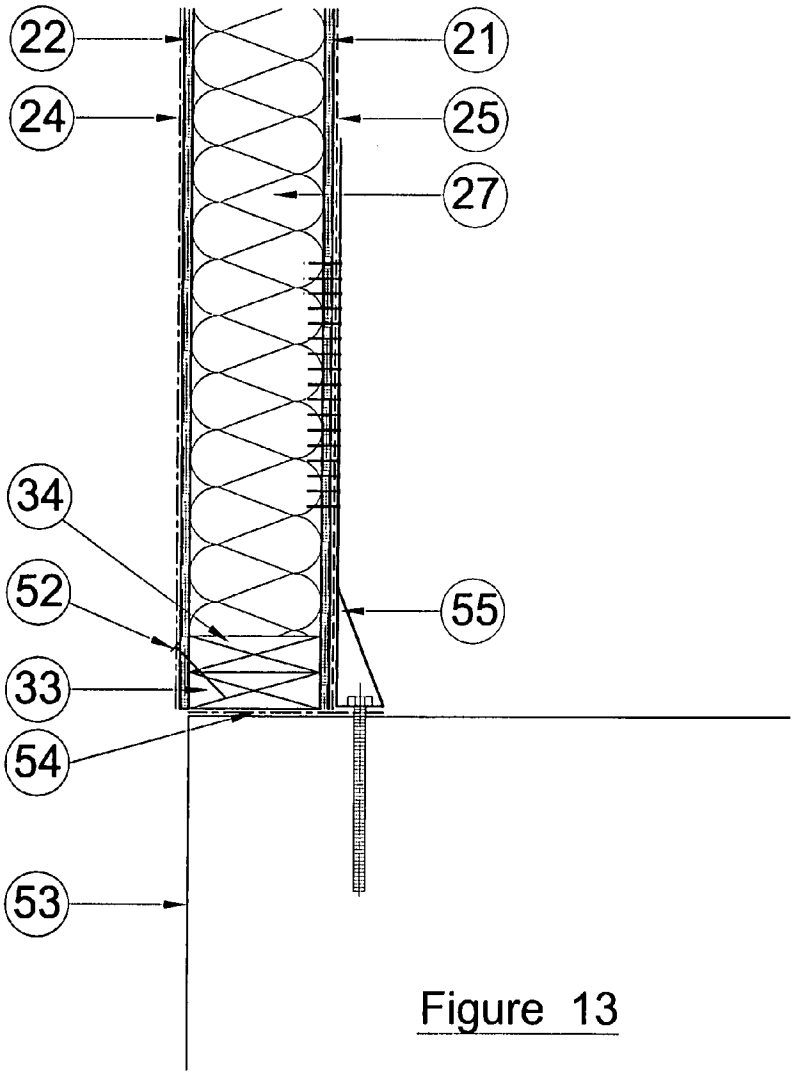

FIG. 13—shows a vertical section of an external system wall panel with additional anchorage to the base.

Figure 14:
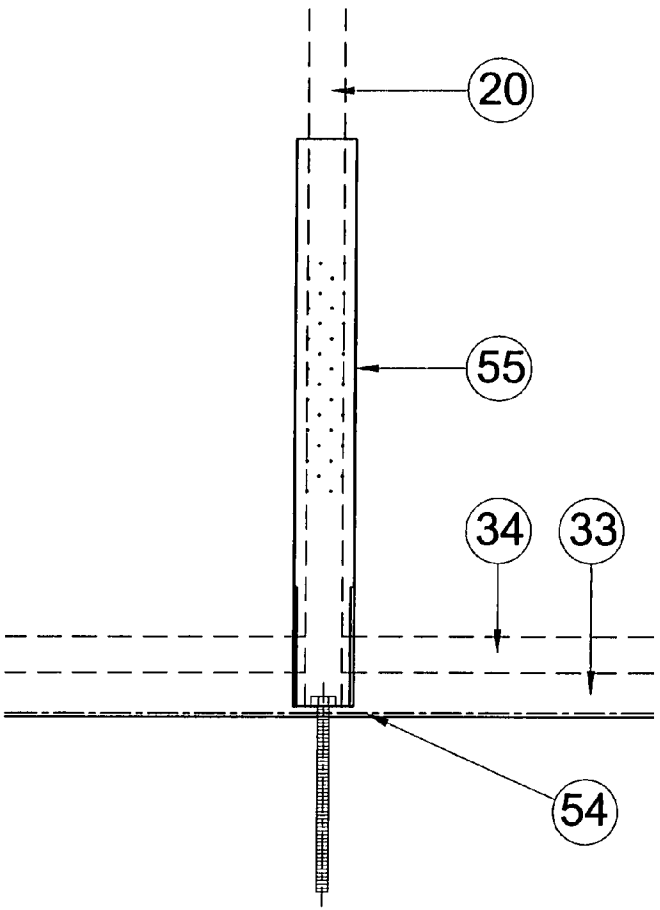

FIG. 14—shows an elevation of an external system wall panel with additional anchorage.

Referring to FIG. 1 there is shown an exploded diagram of a typical timber frame two storey detached dwelling. It also locates the components described in FIG. 2.

Referring to FIG. 2 there is shown an example of a section through the system in a plan view. In this figure the make-up of the system comprises of vertical timbers 20 generally 140×38 mm Canadian Lumber Standard (CLS) and spaced at 600 mm centres forming part of the framework. Sheathing material 21 & 22 is generally 9 mm×2400×1200 mm Oriented Strand Board (OSB) or Plywood and is fixed to both faces of the vertical timbers 20 with metal fixings 52. An external hole 28 acting as access for ingress of expanding polyurethane foam insulation 27, which will be described in FIGS. 3 and 4. Expanding Polyurethane in its liquid form is injected into the void in the framework through the external entrance holes 28 and on contact with air in the void expands to fill the void fully. Breather membrane 24 is fixed to the external face of the system wall panel with stainless steel staples. The Heat Reflecting Membrane (HRM) 25 is applied during the assembly of the system panel on site.

Once the HRM 25 is fixed to the system panel a timber batten 23 generally 25×38 mm is fixed through the HRM 25 and internal sheathing 21 into the timber framework 20. The Gypsum based wallboard 32 is fixed on to the vertical battens 23 to form an air gap 29. The air gap 29 will also house the wiring and pipe work for electrical and plumbing services. Extruded polyurethane foam insulation 26 is fixed through the breather membrane 24 and external sheathing 22 into the timber framework. The external cladding which could be brickwork, stonework, render, tile hanging, timber or cement based boards is fixed to the timber system panel as shown in FIG. 3 forming a cavity 30 between the external cladding 31 and Expanded Polyurethane foam insulation 26.

Referring to FIG. 3 which shows a vertical section through a two storey building illustrating the system and also shows the base rail 34 and top rail 36 which are fixed to the vertical timbers 20 to form the system wall framework of varying dimensions. A 38×140 mm horizontal timber (CLS) known as the head binder 35 is fixed to the top of the system wall panel. The sheathing 21 & 22 projects beyond the top rail 36 and bottom rail 34 to enable on site nailing through into the head binder 35 or the soleplate 33 securing the system wall panel. This fixing system is shown in more detail in FIG. 7.

The timber floor joist 37 to the perimeter sandwiched between the system wall panel. A horizontal batten 38 used for the same purpose as timber batten 23 but fixed horizontally rather than vertically. Eaves detail 39 illustrates the finishing off of the external wall cladding 31 and Extruded Polyurethane Foam Insulation 26. Quilt insulation 40 is fitted between joists 37. Two layers of quilt insulation 41, first layer to be laid along the roof timbers and the second layer to be laid across the first layer.

Quilt insulation 42 fitted to any voids in the joist area. Stainless steel brick ties 43 anchoring the external cladding 31 to the system wall panel through the extruded polyurethane foam insulation 26 and breather paper 24 into the framework. Roof cladding material 44. Gypsum based wallboard ceiling cladding 45. Floor decking 46 fitted onto joists 37. Extruded polyurethane foam insulation and floor finish 47.

Referring to FIG. 4 there is shown a complete system wall panel with and without a window aperture and a top and bottom end elevation. The timber lintel 50 extends beyond each side of the window aperture. The air exit holes 51 situated on the base rail 34 sit opposite the Entrance hole for Insulation 28 and allows air to be expelled during the ingress of insulation into the void created between the external sheathing 22 and the internal sheathing 21 when fixed to the vertical timbers 20 and the base rail 34 and top rail 36.

Referring to FIG. 5 there is shown a section on a slope across the pitch of a system roof panel showing the counter batten 48 fixed on top of the extruded polyurethane foam insulation 26, to the vertical timbers 20.

Referring to FIG. 6 there is shown a horizontal section across the system floor panel showing the larger horizontal timbers 49, generally 38×235 mm.

Referring to FIG. 7 there is shown a vertical section through a system wall panel junction prior to fixing, hereafter described as a male and female end forming a junction. In this figure the soleplate 33 is fixed through the damp proof course 54 into the foundation 55. The figure shows that the internal sheathing 21 and external sheathing 22 extend passed the base rail 34 by the same height as the soleplate 33.

Referring to FIG. 8 there is shown a vertical section through a system wall panel fixed at the base, this figure also shows how the overlap of the sheathing 21 & 22 passed the base rail 34 fits over the soleplate 33 and is then fixed securely into place with appropriate metal fixings 52.

Referring to FIG. 9 there is shown a plan section through a system wall panel junction prior to fixing. This shows an additional vertical timber 20 fixed to the first vertical timber 20 at one side of the panel forming the male part of the junction, at the other side of the panel the internal sheathing 21 and external sheathing 22 overlap vertical timber 20 to form the female part of the junction, similar to that shown in FIGS. 7 and 8.

Referring to FIG. 10 there is shown a plan section through a system wall panel junction after fixing, it also shows how the overlap of sheathing 21 & 22 fits over the extra vertical timber 20 to form a strong joint when fixed with the appropriate metal fixings 52.

Referring to FIG. 11 which shows a plan section through the system wall panel external corner junction prior to fixing, it also shows the internal sheathing 21 which ends 9 mm before the extra vertical timber 20 which forms the male part of the junction. The panel which will fix onto the corner junction has the internal sheathing 21 and external sheathing 22 overlapping the vertical timber 20 to the form the female part that forms the joint with the male part as described in FIG. 12.

Referring to FIG. 12 which shows a plan section through a system wall panel external corner junction after fixing, it also shows that the overlapping sheathing 21 & 22 on the panel with the female part of the junction fits over the corner junction, filling the 9 mm space left between the internal sheathing 21 and vertical timber 20, this forms the corner junction with the male part created by the extra vertical timber 20.

Referring to FIG. 13 there is shown a vertical section of an external system wall panel with additional anchorage to the base, this is achieved by fixing an additional metal anchor 55 under the heat reflecting membrane 25 and through the internal sheathing 21 into the vertical timber 20. A bolt is then fixed through the anchor 55 and damp proof course 54 into the foundations 53.

Referring to FIG. 14 there is shown an elevation of an external system wall panel with additional anchorage, it shows the additional anchor 55 fixed into the vertical timber 20 and the bolt holding the anchor through the damp proof course 54 into the foundations 53. Additional Anchorage is only required to suit localised conditions.

The fully insulated timber frame panel system provided in accordance with the invention.

The system itself, due to the combination of materials used and in the way they are used, provides for a minimum 0.11 $W/m^2K$ of heat loss through a wall and the effect of this is that the combination of the components described will potentially make central heating systems obsolete.

The preferred embodiment of the present invention provides a number of advantages over all previous timber frame systems. Most particularly the invention provides an external closed panel system, a combination of a highly insulated system wall panel produced under quality controlled factory conditions resulting in the production of a product with a strength that is technically superior to any available products.

One of the elements of the system is the fixing of the panels as shown in FIGS. 7 and 8. This overcomes previous problems associated with closed panel systems. This fixing method combined with the other elements of the systems is unique and provides a structure of exceptional strength.

The invention retains the structural and thermal integrity of any timber frame design and cladding options.

The invention because of its improved thermal and acoustic performance will reduce consumer running costs and conserve the worlds natural energy resources.

The invention claimed is:

1. A fully insulated timber frame building panel system incorporating wall, ceiling and floor panels of varying dimensions, the panels comprising:

vertical and horizontal timbers sheathed on both sides to create a cavity which is filled with expanding polyurethane foam insulation;

a breather membrane coupled to an external face of the panel;

a heat reflecting membrane coupled to an internal face of the panel;

a plurality of battens coupled to the internal face of the panel;

a gypsum based board configured to sheath the battens coupled to the internal face of the panel to form an air gap;

extruded polyurethane foam insulation coupled to the external face of the panel through the breather membrane; and external cladding positioned adjacent to the external face of the panel to create a cavity between the extruded polyurethane foam insulation and the external cladding, wherein the external cladding can be a variety of materials.

2. A panel as part of the system in claim 1 with either male or female ends on all its end surfaces to create interlocking junctions when assembled.

3. An insulated timber framed building panel comprising interior and exterior sheathing board layers with a first layer of heat insulating material interposed between said sheathing board layers, wherein a breathable membrane layer is provided on an exterior side of the exterior sheathing board layer and a second layer of heat insulating material is provided on an exterior side of said breathable membrane layer, wherein a heat reflecting membrane layer is provided on an interior side of the interior sheathing board layer, and wherein a further interior sheathing board layer is provided a distance from an interior side of said heat reflecting membrane layer to define a second heat insulating air gap between the further interior sheathing board layer and the heat reflecting membrane layer.

4. A panel according to claim 3, wherein a layer of cladding is provided a distance from an exterior side of said second layer of heat insulating material to define a first heat insulating air gap between the cladding layer and the second layer of heat insulating material.

5. A panel according to claim 4, wherein said layer of cladding is fixed to at least one timber batten which is fixed to said second layer of heat insulating material, such that said first heat insulating air gap is defined between the cladding layer, the second layer of heat insulating material and the at least one timber batten.

6. A panel according to claim 3, wherein said further interior sheathing board layer is fixed to at least one timber batten which is fixed to said heat reflecting membrane layer, such that said second heat insulating air gap is defined between the further interior sheathing board layer, the heat reflecting membrane layer and the at least one timber batten.

7. A panel according to claim 3, wherein adjacent edges of the interior and exterior sheathing board layers overlie said first layer of heat insulating material by a predetermined distance to define a channel between the sheathing board layers extending along a first edge of the panel, said channel being configured for mating receipt of a first projection.

8. A panel according to claim 7, wherein said channel has a depth which is approximately equal to a height of said first projection.

9. A panel according to claim 7, wherein said first projection is connected to one of a further insulated building panel and a building structure other than a further insulated panel.

10. A panel according to any one of claim 7, wherein a second projection is provided along a second edge of said panel.

11. A panel according to claim 3, wherein the first layer of heat insulating material comprises expanded polymer foam.

12. A panel according to claim 3, wherein the second layer of heat insulating material comprises an extruded polymer foam.

* * * * *